United States Patent [19]

Kollmar

[11] 4,208,935

[45] Jun. 24, 1980

[54] CONTROL SYSTEM FOR A HYDRAULIC PRESS

[75] Inventor: Friedrich Kollmar, Grafenau, Fed. Rep. of Germany

[73] Assignee: Moog GmbH, Böblingen, Fed. Rep. of Germany

[21] Appl. No.: 11,109

[22] Filed: Feb. 12, 1979

[30] Foreign Application Priority Data

Feb. 24, 1978 [DE] Fed. Rep. of Germany ..... 2808091

[51] Int. Cl.[2] ..... B26D 5/12

[52] U.S. Cl. ..... 83/617; 72/443; 83/639; 100/269 R

[58] Field of Search ..... 83/617, 639; 100/269 R; 72/443

[56] References Cited

U.S. PATENT DOCUMENTS

| | | | |
|---|---|---|---|
| 3,827,328 | 8/1974 | LaFlamme et al. | 83/617 |
| 4,022,096 | 5/1977 | Forichon | 83/639 X |
| 4,116,122 | 9/1978 | Linder et al. | 100/269 R X |

FOREIGN PATENT DOCUMENTS

| | | | |
|---|---|---|---|
| 565752 | 7/1977 | U.S.S.R. | 83/617 |

*Primary Examiner*—Frank T. Yost

*Attorney, Agent, or Firm*—Sommer & Sommer

[57] ABSTRACT

A control system for a hydraulic punch press is adapted to dissipate the energy stored in a hydraulic actuator so that the punch will exit the workpiece without substantial release impact. The control system includes a signal generator for producing a progressively increasing command signal while the punch penetrates the workpiece, a position transducer for producing a negative feedback signal indicating the actual punch position during such penetration, and a summing point for supplying the difference between the command and actual signals as an error signal to a servovalve used to control operation of the actuator.

14 Claims, 4 Drawing Figures

CONTROL SYSTEM FOR A HYDRAULIC PRESS

BACKGROUND OF THE INVENTION

1. Field of the Invention

The present invention relates generally to the field of control systems for hydraulic presses, and more particularly to an improved control system which is particularly suited for use with a hydraulic punch press to reduce the release impact of the punch as it exits a workpiece.

2. Description of the Prior Art

Workpieces, such as sheet metal, are commonly punched or stamped by hydraulic presses. Relatively great forces between the punch and bottom die occur as the punch moves through the workpiece. These forces produce correspondingly large deformation energies in the workpiece and press, and particularly in the hydraulic fluid of the activating cylinder. These deformation energies are released suddenly as the tool passes through the workpiece in such a way that they suddenly accelerate the punch, thereby creating objectionable noise and strain on the press.

To cushion or dampen this "release impact", it is known to provide shock-absorbing elements on the press to cushion the sudden release of the ram when the punch exits the workpiece. It is also known to provide such damping elements on the tool itself. The use of these damping elements is somewhat complex, and it is difficult to adjust the point of engagement, especially when a plurality of such elements are employed. Moreover, these damping elements must be changed or adjusted every time the tool is changed.

SUMMARY OF THE INVENTION

The invention provides a control system for a hydraulic press having a hydraulic actuator, as electrohydraulic servovalve operatively arranged to supply pressurized hydraulic fluid from a suitable source thereof to the actuator to cause selective movement of its extensible ram, and having an upper die mounted on the ram for movement toward a lower die, and wherein a workpiece is adapted to be interposed between the upper and lower dies.

The control system comprises: signal generator means, such as a function generator, for generating, during a controlled portion of the ram's range of movement, a progressively increasing command signal indicating the desired position of the upper die during such controlled portion; feedback means arranged to generate a negative feedback signal indicating the actual position of the upper die during such controlled portion; and summing means operatively arranged to supply the difference between the command and feedback signals as an error signal to the servovalve.

The progressively increasing command signal may be a linear or logarthimic function generated by a function generator, and may be superimposed on a constant base signal supplied by a set point generator. The feedback signal may trigger the start of such ram movement controlled portion.

The control system may be mounted on a hydraulic punch press to dissipate the pressure in the actuator as the workpiece is stressed into and beyond its plastic range, so that the punch will exit the workpiece without any substantial release impact.

Accordingly, one general object of the invention is to provide an improved control system for a hydraulic press.

Another object is to provide a means for reducing the release impact of a hydraulic punch press as the punch exits the workpiece.

Another object is to provide a control system for controlling the movement of a punch through a workpiece.

These and other objects and advantages will become apparent from the foregoing and ongoing specification, the drawings, and the appended claims.

DESCRIPTION OF THE PREFERRED EMBODIMENT(S)

Figure 1:
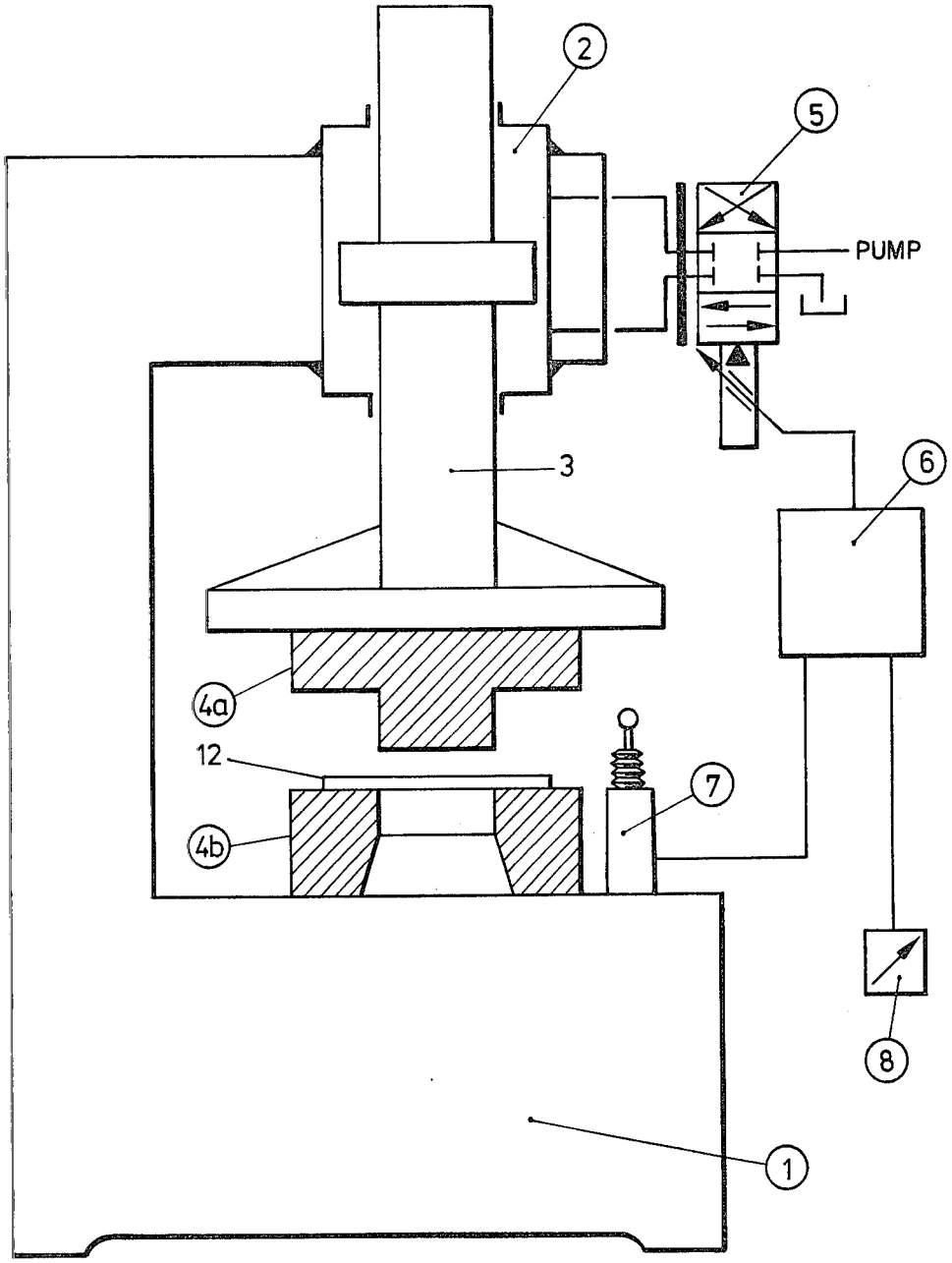
FIG. 1 is a schematic of a hydraulic punch press incorporating the improved control system.

At the outset, it should be clearly understood that like reference numerals are intended to identify the same elements and/or structure consistently throughout the several drawing figures, as such elements and/or structure may be further described or explained by the entire written specification, of which this detailed description is an integral part.

The invention provides an improved control system for use in association with a hydraulic press. The improved control system is particularly suited for use with a hydraulic punch press to dissipate the energy stored in a hydraulic actuator as the punch exits the workpiece, thereby to reduce the release impact of such exiting punch. However, the improved control system may be used with other types of hydraulic presses, such as those used in drawing and other pressing operations. Accordingly, as used herein, the term "hydraulic press" is intended in its full generic sense to include many different forms and types of hydraulic presses, of which the hydraulic punch press herein disclosed is only one particular species.

Referring now to the drawings, and more particularly to FIG. 1 thereof, a hydraulic punch press is shown as including a generally C-shaped frame 1; a bidirectional hydraulic actuator 2 mounted on the upper arm of the frame, and having an extensible ram 3 mounted for vertical movement toward and away from a workpiece; an upper die or punch 4*a* mounted on the lower distal end of ram 3 for movement therewith toward and away from a cooperative lower die 4*b* mounted on the lower arm of the frame; and an electrohydraulic servovalve, schematically indicated at 5, operatively arranged to supply pressurized hydraulic fluid from a suitable source thereof (not shown) to actuator 2 to cause such selective upward and downward movement of ram 3 and punch 4*a*. A workpiece 12 is shown as resting on the lower die 4*b*, to be engaged by the punch 4*a* when the ram is moved downwardly.

Still referring principally to FIG. 1, the improved control system 6 is indicated as receiving one input signal from a set point generator 8, and another input signal from position transducer 7. Because this position transducer 7 is not physically contacted by the ram in its upper position or retracted position (FIG. 1), or during its rapid downward approach to the workpiece, it will produce its output signal only during a portion of the downward range of movement of the ram. The control system 6 is shown as being arranged to supply a signal to servovalve 5 to control the operation of actuator 2.

Figure 2:
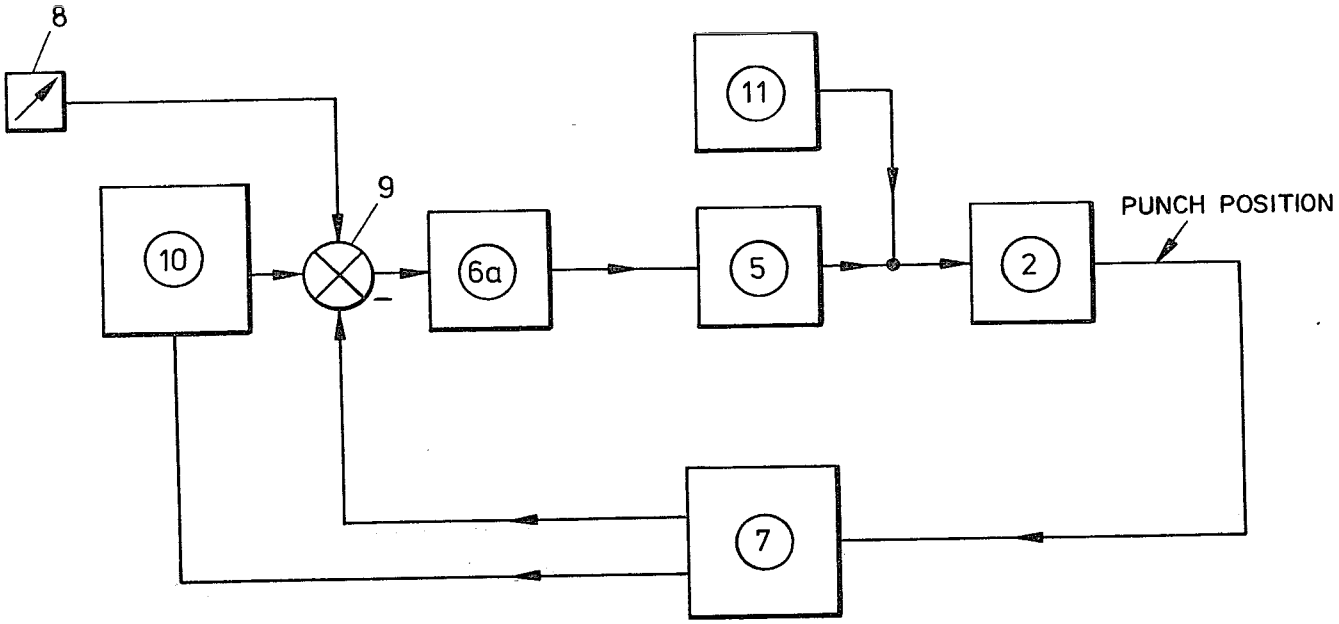
FIG. 2 is a block diagram of the improved control system.

Referring now to FIG. 2, the improved control system is shown as broadly comprising: signal generator means for generating during a controlled portion of the range of movement of the ram, a progressively increasing command signal indicating the desired position of the upper die during such controlled portion; feedback means arranged to generate a negative feedback signal indicating the actual position of the upper die during such controlled portion; and summing means operatively arranged to supply the difference between the command and feedback signals as an error signal to the servovalve for controlling the downward movement of the punch during such controlled portion.

In the preferred embodiment depicted in FIG. 2, the signal generator means includes set point generator 8 and function generator 10. The feedback means includes position transducer 7 which, as indicated in FIG. 1, is arranged to generate a feedback signal indicating the actual position of the ram only during such controlled portion of the ram's downward range of movement. The summing means is shown as including a summing point 9.

In FIG. 2, summing point 9 is supplied with a positive constant base signal from set point generator 8 during the ram's entire range of movement. This summing point 9 is also arranged to receive a progressively increasing positive signal from function generator 10 during the controlled portion of the ram's range of movement. Position transducer 7, which is engaged by the ram at the beginning of the controlled portion, is arranged to supply a negative feedback signal, reflective of the actual position of the ram, to summing point 9, and is also arranged to supply a trigger signal to the function generator to indicate the beginning of the controlled portion of the ram's range of movement and to cause the function generator to produce its constantly increasing signal only during such controlled portion. The signal generated by the function generator may increase linearly, logarithmically or by some other equation, as a function of time. Function generator 10 does not generate its progressively increasing signal before the beginning of the controlled portion of the ram's range of movement. The algebraic sum of the three signals received by summing point 9, is supplied as an error signal to servovalve 5 through a position control amplifier 6a. Block 11 schematically represents the sum of all external disturbances, such as bending of the workpiece and the like, which may affect the signal supplied by servovalve 5 to actuator 2. Transducer 7 is shown as being operatively arranged to convert the actual position of the ram during the controlled portion into its analog electrical signal, which in turn is supplied to summing point 9 as a negative feedback signal.

Figure 4:
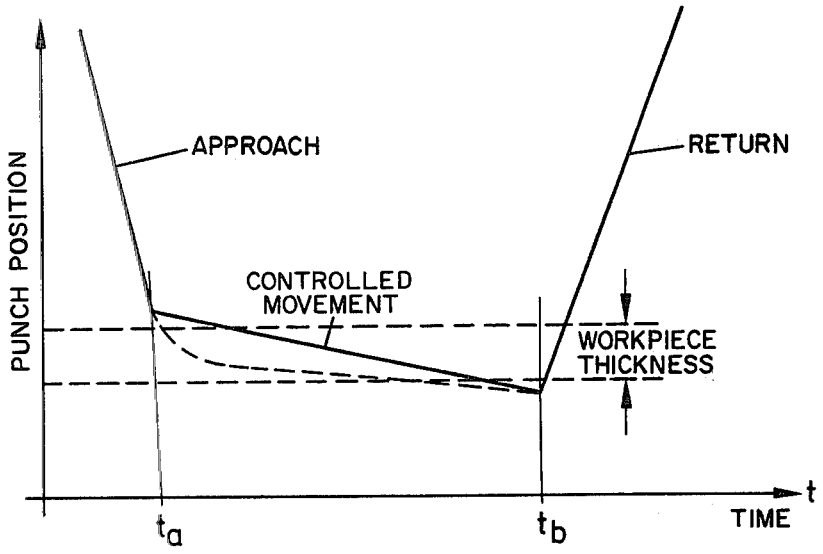
FIG. 4 is a curve showing the position of the punch as a function of time.

The operation of the system shown in FIG. 2 may best be understood with reference to FIG. 4, which depicts the position of punch 4a as a function of time. Assume that the ram is initially in its raised position, as shown in FIG. 1, and that a workpiece has been placed on the bottom die. Thereafter, activation of an "on" signal by suitable means (not shown) will cause set point generator 8 to supply a constant base signal to summing point 9. Because, the ram has not contacted the position transducer, the function generator will not have been triggered into operation and no feedback signal is produced. Hence, only the base signal is supplied as the error signal to the servovalve, which in turn supplies hydraulic fluid to the actuator to cause the ram to move downwardly. The base signal is a constant, and the ram moves downwardly with an initial relatively high constant velocity.

The ram continues to rapidly approach the workpiece at such relatively high velocity until it contacts position transducer 7. Preferably, this contact occurs at, or slightly before, the punch contacts the workpiece, and is indicated at point $t_a$ in FIG. 4. The improved control system operates to control the position of the punch during a controlled portion of the downward range of movement of the ram, this range being between points $t_a$ and $t_b$ in FIG. 4.

When the ram engages the position transducer, the function generator is triggered to begin to produce its progressively increasing output signal, which is superimposed on the constant base signal in the summing point. At the same time, displacement of the position transducer also generates a negative feedback signal, indicating the actual position of the ram, which is also supplied to the summing point. The algebraic sum of all signals received at the summing point is supplied as an error signal to the servovalve to continuously cause the actual position of the ram to follow the command signal. Hence, the ram's position is slaved to follow the command signal.

As previously noted, the signal produced by the function generator may be either a linear or logarithmic function, or may be some other progressively increasing function. If the function generator signal is linear, and if the signal produced by the position transducer is also linear, then the error signal will be substantially constant between $t_a$ and $t_b$, and the punch will move through the workpiece with a substantially constant velocity, although at a slower rate than during its rapid downward approach. Such substantially constant velocity between $t_a$ and $t_b$ will cause the position of the punch to vary linearly as a function of time, this being shown by the solid line between $t_a$ and $t_b$. The slope of this solid line may be varied by changing the gain of the command signal, the gain of the feedback signal, or both. If the function generator generates a logarithmic function, the punch velocity will be non-linear, and punch position may vary as shown by the dashed line between $t_a$ and $t_b$.

After the punch has penetrated the workpiece (i.e., at time $t_b$), suitable means, such as a limit switch or the like, (not shown), may deactivate the control system and cause the servovalve to rapidly return the ram to the initial start position shown in FIG. 1.

The improved control system is particularly suited for use in cushioning or damping the release impact when the punch penetrates the workpiece. The stress-strain curve of the workpiece material may be regarded as having an elastic range and a plastic range. Within the elastic range (i.e., up to the proportional limit), stress and strain are directly related by the modulus of elasticity. In the plastic range beyond the proportional limit, stress and strain are non-linearly related. Indeed, for most materials, a relatively small additional increment of stress in the plastic range will produce a relatively large additional amount of strain. For some materials, stress and strain are inversely related between the ultimate stress and the rupture stress. In other words, beyond the ultimate stress, strain may actually continue even if stress is reduced.

During downward movement of the ram, the pressure in the expansible actuator chamber will vary according to the encountered load. During its rapid initial downward movement, such pressure will be relatively low, because no load is encountered. After the punch engages the workpiece, the actuator pressure will rapidly increase as the workpiece is stressed through the elastic range, and into the plastic range. However, once the material has been stressed into its plastic range, relatively small additional increment of pressure will cause the material to continue to strain at a rate proportional to the velocity of the piston. Finally, after shear occurs, the material will strain easily with relatively little applied load. Hence, the actuator pressure will be relatively low when the punch exits the workpiece.

This is a significant advantage over conventional hydraulic presses wherein the actuator is directly supplied with fluid from a pressure source. There, actuator pressure builds up as the load is encountered, and is released suddenly when the punch exits the workpiece, causing considerable noise and vibration. In the improved system, the energy of the actuator pressure is dissipated when the material begins to strain more easily in the plastic range, and drops to a relatively low value after shear so that the punch will exit the workpiece virtually without release impact.

If the downward velocity of the punch is constant between $t_a$ and $t_b$, then the material must strain at a constant rate. Hence, the pressure in the actuator chamber will vary in a manner similar to a stress-strain curve, if strain is regarded as changing at a constant rate.

Figure 3:
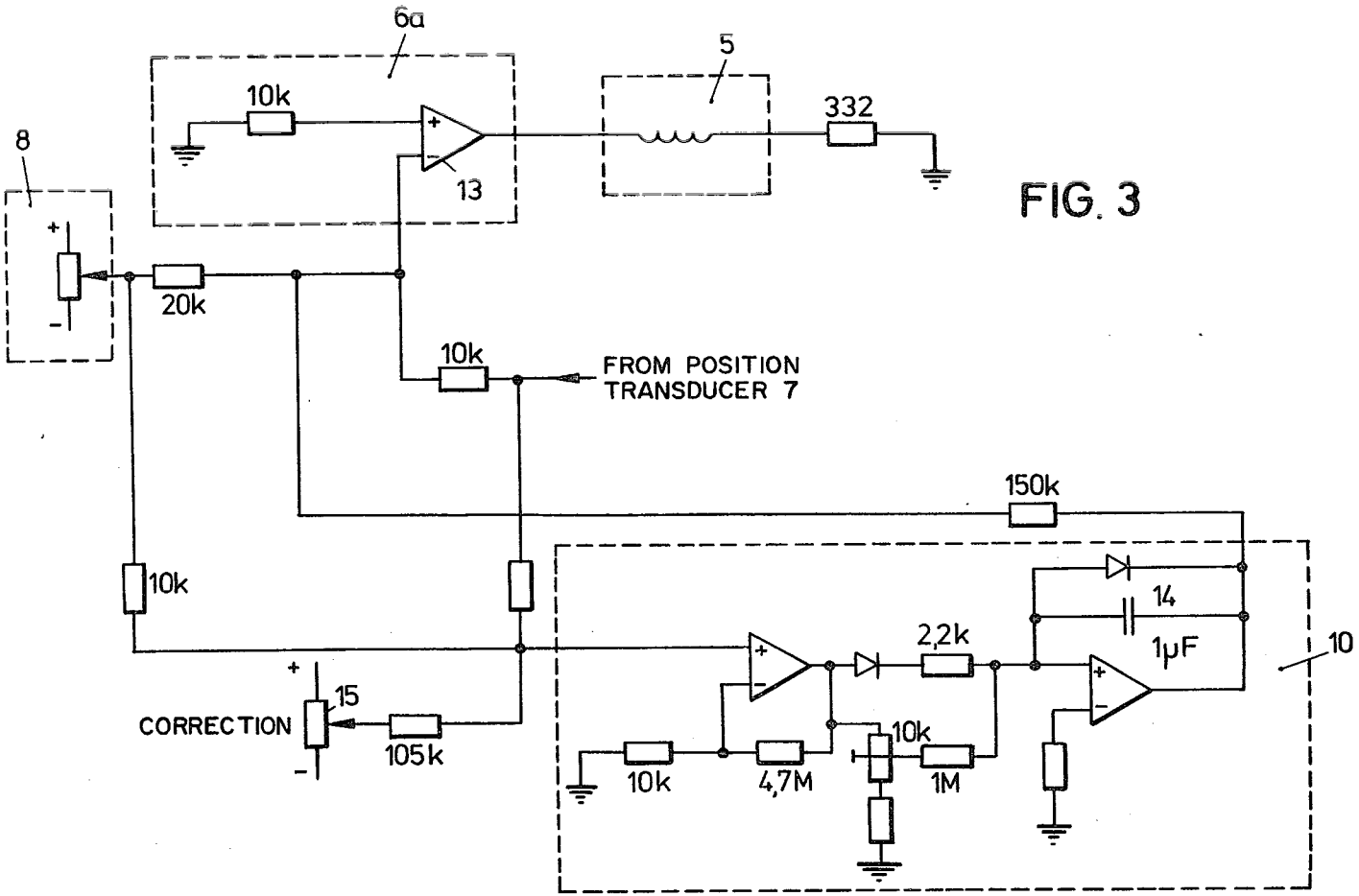
FIG. 3 is a fragmentary electrical schematic of the system shown in FIG. 2.

FIG. 3 is a fragmentary electrical schematic of the block diagram shown in FIG. 2.

In FIG. 3, the set point generator 8 is shown as being a potentiometer. The position control amplifier 6*a* is shown as including an operational amplifier 13 having its non-inverting inlet connected to ground through a 10K ohm resistor. The inverting inlet of amplifier 13 is the summing point. The output of amplifier 13 is supplied to the coil of servovalve 5, which in turn is connected to ground through a 332 ohm resistor. A correction or calibrating potentiometer 15 is connected through two series-connected resistors to the feedback branch signal, which is supplied to the summing inlet of amplifier 13 through a 10K ohm resistor. The middle tap of set point generator 8 is connected to the summing point through a 20K ohm resistor, and is connected to function generator 10 through a 10K ohm resistor and the node between the correction potentiometer resistors. The function generator receives this input at the non-inverting inlet of an operational amplifier, the outlet and inverting inlet terminals of which are connected by a 4.7 M ohm resistor. The inverting inlet is also connected to ground through a 10K ohm resistor. The outlet of this first amplifier is connected to the non-inverting inlet of a second operational amplifier through a diode and a 2.2K ohm resistor. The outlet of the first amplifier is also connected to the non-inverting inlet of the second amplifier through series-connected 10K and 1M ohm resistors. The second amplifier inverting inlet is grounded through a resistor. The non-inverting inlet and outlet of the second amplifier are connected through a parallel-connected capacitor 14 and diode. The outlet of the second amplifier is supplied to the summing point through a 150K ohm resistor.

The most favorable setting of set point generator 8 may readily be found by trial and error. This contemplates reducing the set point value in increments until the punch press operates without any release impact.

The position transducer may be a sliding rheostat, a photo-electric sensing element, or any other element capable of converting position into an analog electrical signal. The improved control system may be installed as original equipment on newly manufactured machinery, or may be provided to retrofit existing presses.

Therefore, while a preferred embodiment of the improved control system has been shown and described, and several modifications thereof discussed, persons skilled in this art will appreciate that additional changes and modifications may be made without departing from the spirit of the invention, as described by the following claims.

What is claimed is:

1. A control system for a hydraulic press, said press having a hydraulic actuator, an electrohydraulic servovalve operatively arranged to supply pressurized hydraulic fluid from a suitable source thereof to said actuator to cause selective movement of its ram, and having an upper die mounted on said ram for movement toward a lower die, and wherein a workpiece is adapted to be interposed between said upper and lower dies, said control system comprising:

signal generator means for generating, during a controlled portion of the range of movement of said ram, a progressively increasing command signal indicating the desired position of said upper die during said portion;

feedback means arranged to generate a negative feedback signal indicating the actual position of said upper die during said controlled portion; and summing means operatively arranged to supply the difference between said command feedback signals as an error signal to said servovalve.

2. A control system as set forth in claim 1 wherein said signal generator means includes a set point generator for producing a constant base signal.

3. A control system as set forth in claim 1 wherein said signal generator means includes a function generator for producing said progressively increasing command signal.

4. A control system as set forth in claim 3 wherein said feedback means is arranged to trigger said function generator to produce said progressively increasing command signal.

5. A control system as set forth in claim 4 wherein said feedback means is arranged to trigger said function generator to produce said progressively increasing command signal at the beginning of said controlled portion.

6. A control system as set forth in claim 1 wherein said command signal increases linearly as a function of time during said controlled portion.

7. A control system as set forth in claim 6 wherein the velocity of said ram is substantially constant during said controlled portion.

8. A control system as set forth in claim 1 wherein said command signal increases logarithmically as a function of time during said control portion.

9. A control system as set forth in claim 1 wherein said command signal includes a constant base signal and a progressively increasing signal superimposed on said constant base signal.

10. A control system as set forth in claim 1 wherein said press is a punch press, said upper die is a punch, and wherein the pressure in said actuator varies as a function of time in a manner substantially similar to the stress-strain curve of the material of which said workpiece is composed.

11. A control system as set forth in claim 10 wherein said control system is adapted to dissipate the energy in said actuator to reduce the release impact of said punch as it exits the workpiece.

12. A control system as set forth in claim 1 wherein said upper die is engaged with said workpiece during said controlled portion of said range of movement.

13. A control system as set forth in claim 1 wherein the incremental pressure supplied to said actuator is reduced after said workpiece has been stressed into its plastic range.

14. A control system as set forth in claim 1 wherein said feedback means includes a position transducer arranged to be engaged by said ram at the beginning of said controlled portion.

* * * * *